US008400244B2

(12) United States Patent
Sato

(10) Patent No.: US 8,400,244 B2
(45) Date of Patent: Mar. 19, 2013

(54) REACTOR

(75) Inventor: Toyoyuki Sato, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 391 days.

(21) Appl. No.: 12/663,128

(22) PCT Filed: Jun. 6, 2008

(86) PCT No.: PCT/IB2008/001454

§ 371 (c)(1),
(2), (4) Date: Dec. 4, 2009

(87) PCT Pub. No.: WO2008/152467

PCT Pub. Date: Dec. 18, 2008

(65) Prior Publication Data

US 2010/0209314 A1 Aug. 19, 2010

(30) Foreign Application Priority Data

Jun. 12, 2007 (JP) ..... 2007-155133

(51) Int. Cl.
*H01F 27/08* (2006.01)

(52) U.S. Cl. ..... 336/55; 336/60; 336/61

(58) Field of Classification Search ..... 336/55, 336/60, 61, 90, 96, 221, 222, 208, 209, 212, 336/65, 83, 219, 234
See application file for complete search history.

(56) References Cited

U.S. PATENT DOCUMENTS 3,374,452 A * 3/1968 Judd ..... 336/60
4,488,134 A * 12/1984 Pfeiffer ..... 336/58
5,271,373 A * 12/1993 Takaishi et al. ..... 123/634
5,285,760 A * 2/1994 Takaishi et al. ..... 123/634
5,313,927 A * 5/1994 Takaishi ..... 123/634
5,463,999 A * 11/1995 Taruya et al. ..... 123/647
5,786,154 A * 7/1998 Bomalaski et al. ..... 435/7.2
5,977,855 A * 11/1999 Matsumura et al. ..... 336/96
6,185,811 B1 * 2/2001 Perry ..... 29/606
7,138,895 B2 * 11/2006 Chung ..... 335/299
7,158,001 B2 * 1/2007 Matsutani et al. ..... 336/55
7,164,584 B2 * 1/2007 Walz ..... 361/704
7,325,563 B2 * 2/2008 Seko ..... 137/341
7,369,024 B2 * 5/2008 Yargole et al. ..... 336/61
7,397,338 B2 * 7/2008 Sano et al. ..... 336/212
2004/0226622 A1 11/2004 Hayashi

FOREIGN PATENT DOCUMENTS

JP 03-208310 A 9/1991
JP 2002-212662 A 7/2002
JP 2003-234516 A 8/2003
JP 2004-095570 A 3/2004
JP 2004-251417 A 9/2004
JP 2004-273657 A 9/2004

(Continued)

*Primary Examiner* — Mohamad Musleh
*Assistant Examiner* — Joselito Baisa
(74) *Attorney, Agent, or Firm* — Sughrue Mion, PLLC

(57) ABSTRACT

A reactor includes a cooling block; a heat radiation base affixed to the cooling block; a reactor core that includes a coil, and that is affixed to the heat radiation base; and a resin molded body formed on the heat radiation base to cover the reactor core. The heat radiation base is formed of a metal or an alloy that has a predetermined logarithmic decrement and predetermined heat conductivity. The predetermined logarithmic decrement is equal to or higher than 0.1, and the predetermined heat conductivity is equal to or higher than 10 W/mK.

4 Claims, 5 Drawing Sheets

FOREIGN PATENT DOCUMENTS

| | | | |
|---|---|---|---|
| JP | 2004-319679 | A | 11/2004 |
| JP | 2005-023362 | A | 1/2005 |
| JP | 2005-072198 | A | 3/2005 |
| JP | 2005-150517 | A | 6/2005 |
| JP | 2005-298952 | A | 10/2005 |
| JP | 2006-351653 | A | 12/2006 |
| JP | 2008-098204 | A | 4/2008 |
| WO | 98/06113 | A1 | 2/1998 |
| WO | 2006/109919 | A1 | 10/2006 |

* cited by examiner

REACTOR

BACKGROUND OF THE INVENTION

1. Field of the Invention

The invention relates to a reactor provided in an electric vehicle, a hybrid vehicle, or the like.

2. Description of the Related Art

In general, in a reactor in an electric power conversion circuit, a reactor core, which has a substantially long ring shape in a plan view, is provided, and a coil is formed around each of two longitudinal portions of the reactor core. The reactor in this state is housed in a case. The reactor core includes partial cores. Each of the partial cores is formed by a stacked body formed of a plurality of electromagnetic steel plates, or by a powder magnetic core. A gap plate formed of a nonmagnetic material is provided between the partial cores. The gap plate is fixed to the partial cores by an adhesive agent. Thus, the reactor core is formed.

A heat sink is provided on the lower surface (bottom surface) of the case. Further, a cooling block is provided under the case. A coolant or air is supplied into the cooling block. In general, heat generated in the coil or the reactor core when an electric current is applied to the coil is released to outside using the heat sink and the cooling block, while the coil and the reactor are cooled. A resin molded body is formed to seal an area between the case and the reactor core housed in the case. Thus, heat is transmitted from the coil or the reactor core to the heat sink via the resin molded body.

A method of manufacturing the reactor in related art includes a large number of processes, for example, a process in which the case is manufactured, a process in which the reactor core including the coil (or a coil bobbin) is housed in the case with the heat sink being disposed under the reactor core, a process in which the resin molded body is formed in the case after the reactor core and the heat sink are housed in the case, and a process in which, for example, grease is applied to the reverse surface of the bottom plate of the case, and then the cooling block is fitted to the reverse surface. Thus, it is important and required to increase the manufacturing yield of the reactor, in mass production of the hybrid vehicle or the like.

A large electric current and a large voltage are generally applied to the reactor provided in the electric vehicle, the hybrid vehicle, or the like. Therefore, the vibration of the reactor is large, and noise due to the vibration is large. Thus, it is urgently required to develop a reactor in which the vibration is effectively suppressed, as well as to increase the manufacturing yield and to increase the heat radiation performance.

For example, Japanese Patent Application Publication No. 2004-95570 (JP-A-2004-95570) describes a reactor device developed to increase the heat radiation performance. In the reactor device, a reactor core is placed on a holding portion of a base that serves as a heat sink, and the reactor core is fixed to the base using a fixing member. The reactor core and the base in this state are integrated with each other using unsaturated polyester. Thus, the reactor device is produced by mold forming.

In the above-described reactor device, heat generated in the reactor core is effectively radiated to the base via the holding portion and a resin molded body. However, in this reactor device as well, the vibration caused when the reactor device is operated is not sufficiently suppressed, as in other reactor devices in related art. Further, it is difficult to increase the manufacturing yield of the reactor device by simplifying the processes for manufacturing the reactor device.

SUMMARY OF THE INVENTION

The invention provides a reactor with heat radiation performance, in which the vibration is suppressed, and which makes it possible to increase a manufacturing yield.

A first aspect of the invention relates to a reactor. The reactor includes a cooling block; a heat radiation base affixed to the cooling block; a reactor core that includes a coil, and that is affixed to the heat radiation base; and a resin molded body formed on the heat radiation base to cover the reactor core. The heat radiation base is formed of a metal or an alloy that has a predetermined logarithmic decrement equal to or higher than 0.1, and a predetermined heat conductivity equal to or higher than 10 W/mK.

In the reactor according to the first aspect, a housing, which is a constituent member of the conventional reactor, is omitted. For example, the cooling block and the heat radiation base on the cooling block are integrally fixed to each other, and the reactor core including the coil is placed on the heat radiation base. Then, the resin molded body is formed to cover the reactor core. Thus, the reactor according to the first aspect is produced. Accordingly, it is possible to reduce the number of components in comparison to conventional reactors, and to increase the manufacturing yield by reducing the number of manufacturing processes.

Further, the heat radiation base, on which the reactor core is directly placed, is formed of a material that has both of a predetermined level of heat radiation performance and a predetermined level of vibration damping performance.

In the above-described aspect, the heat radiation base may be formed of magnesium (Mg), nickel (Ni), iron (Fe), a manganese-zirconium alloy (Mg—Zr alloy), an aluminum-zinc alloy (Al—Zn alloy), a nickel-titanium alloy (Ni—Ti alloy), or a manganese-copper-nickel alloy (Mn—Cu—Ni alloy).

In the above-described aspect, a liquid coolant or air may be circulated in the cooling block. With this configuration, it is possible to effectively cool the heat radiation base.

A second aspect of the invention relates to a reactor. The reactor includes a cooling block; a heat radiation base affixed to the cooling block; a reactor core that includes a coil, and that is affixed to the heat radiation base; and a resin molded body formed on the heat radiation base to cover the reactor core. The heat radiation base is formed of a metal or an alloy that has a predetermined logarithmic decrement and a predetermined heat conductivity. The heat radiation base may be formed of Mg, Ni, Fe, a Mg—Zr alloy, an Al—Zn alloy, a Ni—Ti alloy, or a Mn—Cu—Ni alloy.

The reactor according to the invention has high heat radiation performance and high vibration damping performance. Further, according to the invention, it is possible to reduce the number of components, and to reduce the size and weight of the reactor by omitting the housing. Thus, the reactor according to the invention is appropriate for the use in the latest hybrid vehicle, electric vehicle, or the like in which high-performance, light, and small devices need to be provided.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
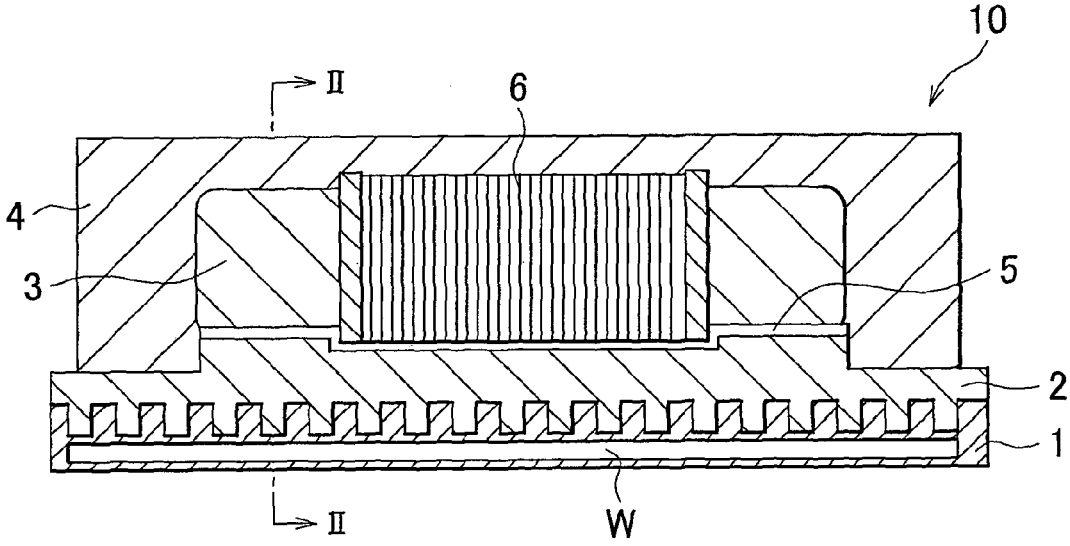
FIG. 1 is a longitudinal sectional view showing a reactor according to an embodiment of the invention.
Figure 2:
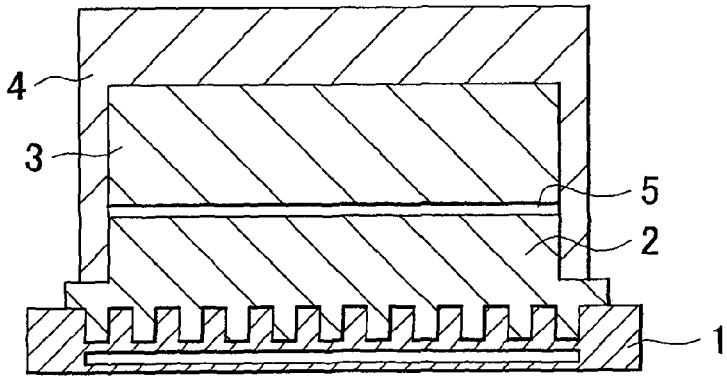
FIG. 2 is a sectional view taken along the line II-II in FIG. 1.
Figure 3:
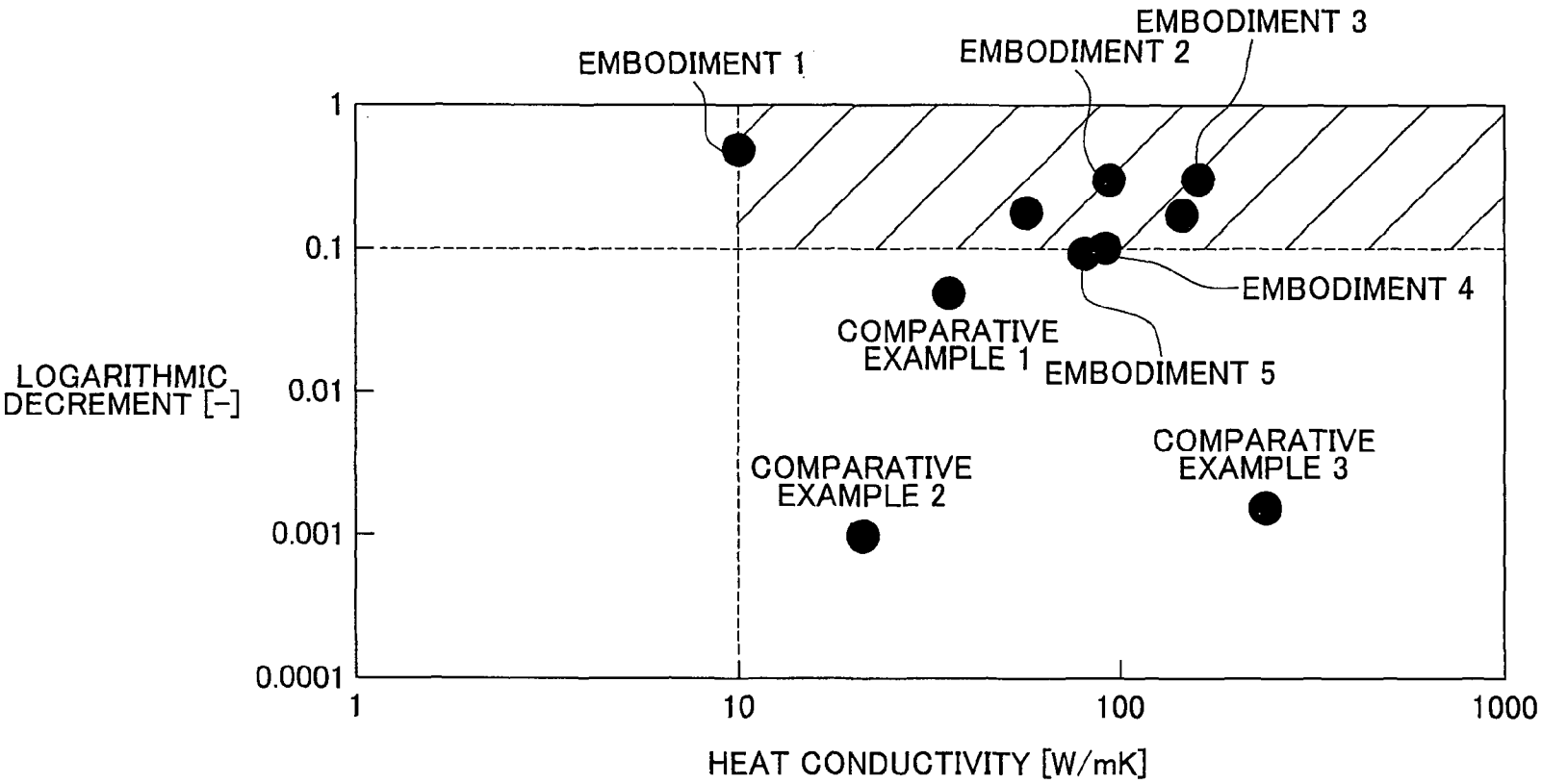
FIG. 3 is a graph showing the result of examination relating to logarithmic decrements and heat conductivities of metals/alloys.
Figure 4:
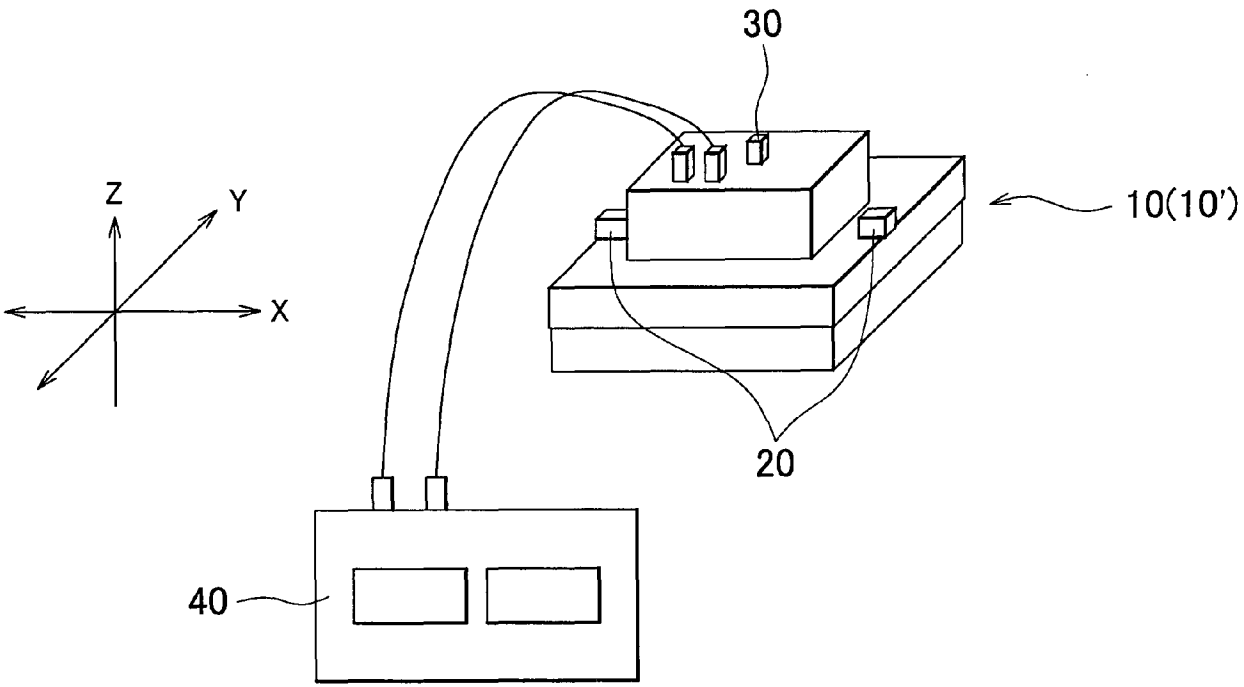
FIG. 4 is a diagram schematically illustrating an experiment relating to vibration of the reactor.
Figure 5:
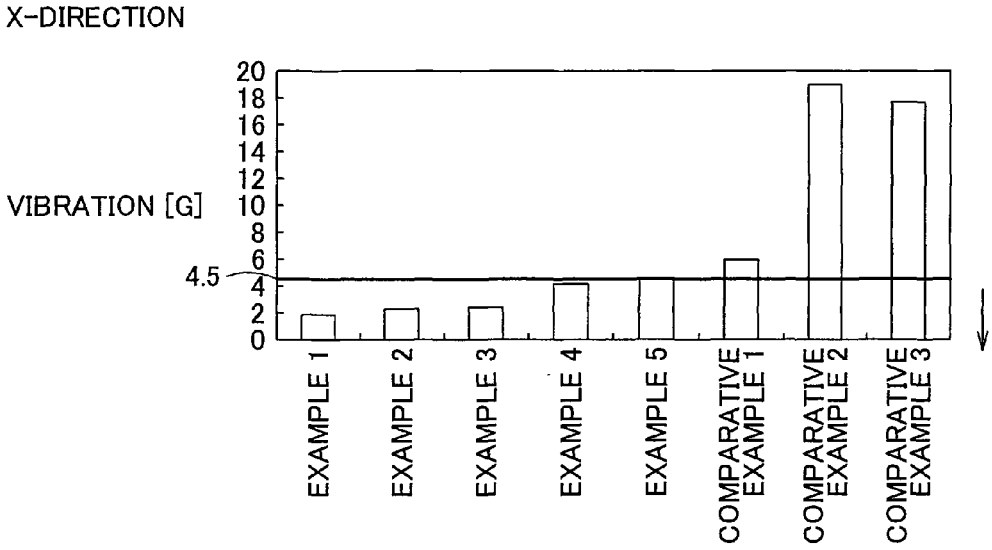
FIG. 5 is a graph showing the result of measurement of vibration in an X-direction in the vibration experiment.
Figure 6:
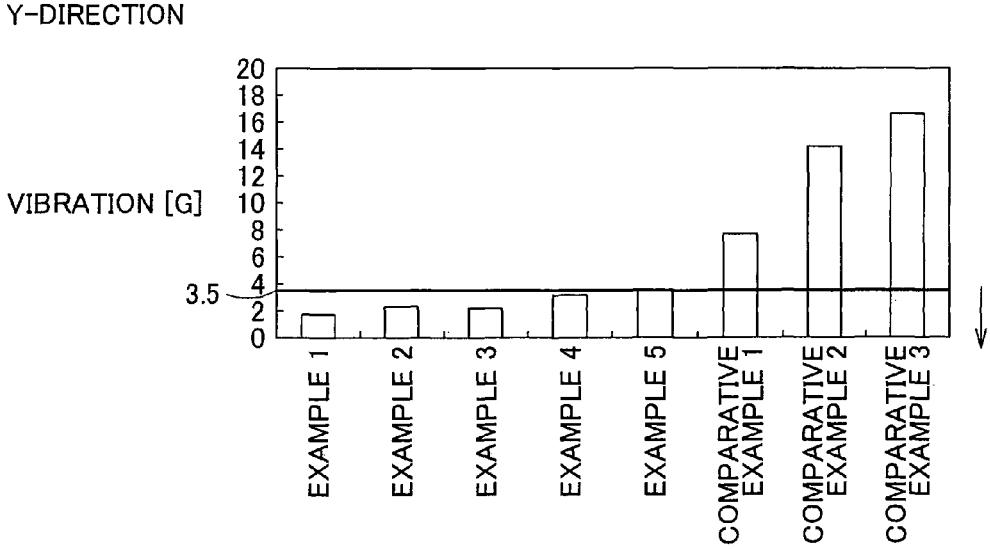
FIG. 6 is a graph showing the result of measurement of vibration in a Y-direction in the vibration experiment.
Figure 7:
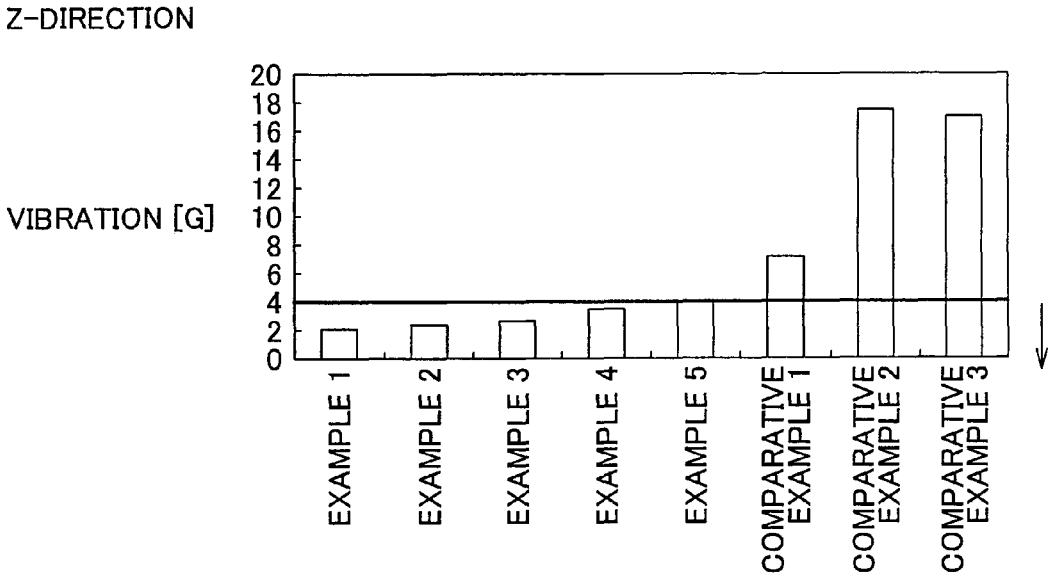
FIG. 7 is a graph showing the result of measurement of vibration in a Z-direction in the vibration experiment.
Figure 8:
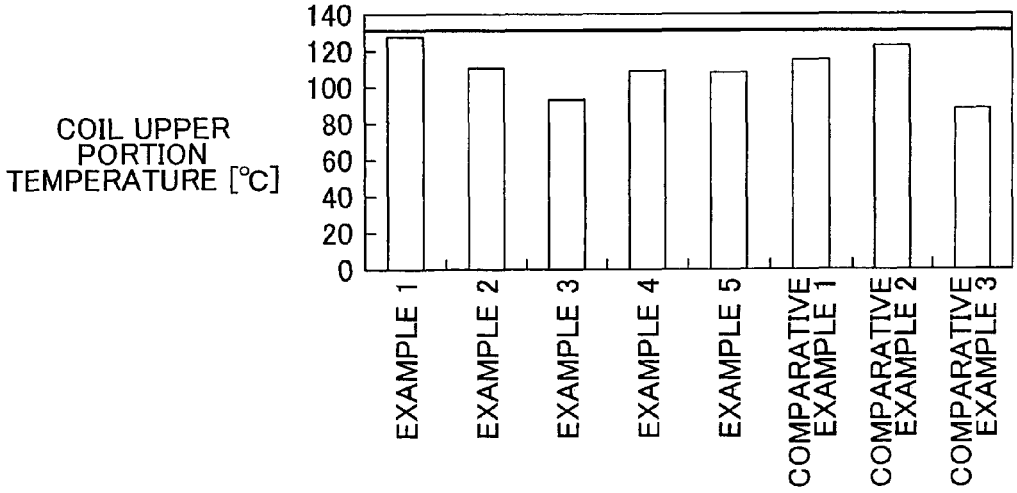
FIG. 8 is a graph showing the result of measurement of the temperature of an upper portion of a coil.

Hereinafter, an embodiment of the invention will be described with reference to the drawings. FIG. 1 is a longitudinal sectional view showing a reactor according to an embodiment of the invention. FIG. 2 is a sectional view taken along the line II-II in FIG. 1. FIG. 3 is a graph showing the result of examination relating to logarithmic decrements and heat conductivities of metals/alloys. FIG. 4 is a diagram schematically illustrating an experiment relating to vibration of the reactor. FIGS. 5 to 7 are graphs showing the results of measurement of vibration in an X-direction, vibration in a Y-direction, and vibration in a Z-direction, respectively in the vibration experiment. FIG. 8 is a graph showing the result of measurement of the temperature of an upper portion of a coil.

FIG. 1 is a longitudinal sectional view showing the reactor 10 according to the embodiment of the invention and FIG. 2 is a sectional view taken along the line II-II in FIG. 1. The reactor 10 includes a cooling block 1, a heat radiation base 2, a reactor core 3, and a resin molded body 4 that are arranged in the stated order in a direction from a lower position to an upper position. A coolant W is supplied to the cooling block 1 from a radiator or the like. The heat radiation base 2 is fixed to the cooling block 1. The reactor core 3 is fixed to an upper surface of the heat radiation base 2 by an epoxy adhesive agent 5. In the reactor core 3, a coil 6 is formed. The resin molded body 4 seals the reactor core 3 including the coil 6, and the exposed upper surface of the heat radiation base 2. The reactor core may be formed by joining an I-shaped magnetic core to a U-shaped magnetic core using an adhesive agent. Also, a gap plate may be used to form an air gap. Each of the I-shaped core and the U-shaped core may be formed by a stacked body that is formed by stacking silicon steel plates. Alternatively, each of the I-shaped core and the U-shaped core may be formed by a powder magnetic core formed by pressing magnetic power produced by covering soft magnetic metal power or soft magnetic metal oxide powder with a resin binder. If the cores are formed using a magnetic powder, iron powder, iron-silicon alloy powder, iron-nitrogen alloy powder, iron-nickel alloy powder, iron-carbon alloy powder, iron-boron alloy powder, iron-cobalt alloy powder, iron-phosphorus alloy powder, iron-nickel-cobalt alloy powder, or iron-aluminum-silicon alloy powder, for example, may be used. The gap plate may be formed of, for example, ceramic such as alumina ($Al_2O_3$) or zirconia ($ZrO_2$).

The resin molded body 4 is formed of an epoxy resin, for example, an urethane resin, or the like. The cooling block 1, the heat radiation base 2, and the reactor core 3 are integrally fixed to each other, and placed in a mold (not shown). Then, a resin material is filled into the mold, and pressure forming is performed. Thus, the resin molded body 4 shown in FIG. 1 is formed.

The temperature of the coolant W supplied to the cooling block 1 from the radiator or the like, is approximately 65° C., and thus, relatively high. However, even at this temperature, the temperature of the coolant W is sufficiently cold to cool the coil 6, which is at a temperature of at least 100° C., and the reactor core 3, which closely contacts the coil 6, when the reactor 10 is operating.

The heat radiation base 2 is formed of a metal material or an alloy material that has both of a predetermined level of vibration damping performance and a predetermined level of heat radiation performance.

In the embodiment, a criterion relating to the vibration damping performance is that the logarithmic decrement is equal to or higher than 0.1. The criterion of the logarithmic decrement is set to meet predetermined three-dimensional vibration criteria, as described later. Another criterion, relating to the heat radiation performance, is that the heat conductivity is equal to or above 10 W/mK. The criterion of the heat conductivity is set so that the temperature of the upper portion of the coil is equal to or below a predetermined temperature when the reactor 10 is operating.

In FIG. 3, each point denoted by "examples 1 to 5" indicates a metal or an alloy that meets both of the above criteria. Each point denoted by "comparative examples 1 to 3" indicates a metal or the that does not meet one of the criteria.

Metals/alloys in the examples 1 to 5 are a Mn—Cu—Ni alloy, a Mg—Zr alloy, Mg, Ni, and Fe, respectively. Other alloys that meet both criteria include, for example, A—Zn alloy and a Ni—Ti alloy.

Metals in the comparative examples 1 to 3 are Pb, Ti, and Al, respectively. Another metal that fails to meet at least one of the criteria is Cu.

Accordingly, a Mn—Cu—Ni alloy, a Mg—Zr alloy, an Al—Zn alloy, a Ni—Ti alloy, Mg, Ni, or Fe is selected as the material of the heat radiation base 2 included in the reactor 10 according to the embodiment.

As shown in FIG. 1, the reactor 10 does not include the resin housing. Therefore, the size and weight of the reactor 10 are reduced, as compared to conventional reactors. Further, the reactor core is affixed to the heat radiation base, and the heat radiation base is formed of a metal or an alloy that that exhibits the requisite vibration damping performance and heat radiation performance. Thus, the reactor 10 has both of the vibration damping performance and the heat radiation performance.

As shown in FIG. 4, a power source 40 was connected to a reactor, and the reactor was operated. At this time, vibration was measured using an acceleration pickup 20, and the temperature of the upper portion of the coil was measured using a thermocouple 30. The experiment was conducted on the reactors 10 in which the heat radiation bases are formed of the metals or the alloys specified in the examples 1 to 5, and reactors 10' in related art, in which heat sinks are formed of the metals specified in the comparative examples 1 to 3. As shown in FIG. 4, the vibration in each of the X-direction and the Y-direction that define a plane, and the vibration in the vertical Z-direction were measured in vibration acceleration (G=gal). Then, it was determined whether the vibration in each direction was equal to or below a criterion value. The criterion value of the temperature of the upper portion of the coil was set to 130° C., and it was determined whether the temperature of the upper portion of the coil was equal to or below the criterion value. Each criterion value of the vibration acceleration and the criterion value of the temperature may be changed as appropriate.

FIG. 5 shows the measured vibration in the X-direction. FIG. 6 shows the measured vibration in the Y-direction. FIG. 7 shows the measured vibration in the Z-direction. FIG. 8 shows the result of measurement of the temperature measured at the upper portion of the coil. Table 1 shows the collective results.

TABLE 1

| | Measured vibration (G: gal) | | | Temperature measured at upper |
|---|---|---|---|---|
| | X-direction Criterion: 4.5G or lower | Y-direction Criterion: 3.5G or lower | Z-direction Criterion: 4.0G or lower | portion of the coil: Criterion: 130° C. or lower |
| Example 1 | 1.8 | 1.7 | 2.1 | 127 |
| Example 2 | 2.3 | 2.2 | 2.5 | 111 |
| Example 3 | 2.5 | 2.1 | 2.7 | 94 |
| Example 4 | 4.2 | 3.1 | 3.4 | 109 |
| Example 5 | 4.5 | 3.4 | 4.0 | 108 |
| Comparative example 1 | 5.9 | 7.6 | 7.2 | 114 |
| Comparative example 2 | 18.9 | 14.1 | 17.7 | 122 |
| Comparative example 3 | 17.7 | 16.4 | 17.0 | 88 |

With regard to the vibration characteristic, FIGS. 5 to 7 and Table 1 show that each reactor 10 that includes a heat radiation base formed of the metals or alloys specified in examples 1 to 5 meets all the vibration criteria, and the vibration acceleration in the reactors 10 is at most approximately 25% that of the reactors 10', which the heat sinks formed of Ti and Al in the comparative examples 2 and 3.

With regard to the temperature of the upper portion of the coil, FIG. 8 and Table 1 show that each reactor 10 that includes a heat radiation bases base formed of the metals or alloys in the examples 1 to 5 meets the criterion, and each reactor 10' that includes a heat sink formed of the metals specified in the comparative examples 1 to 3 also meets the criterion. The result shows that even the heat sinks of the reactors 10', which are formed of the metal materials specified in the comparative examples, sufficiently provide the heat radiation performance. Thus, the result is considered to be appropriate.

The results of the experiments show that it is possible to produce a reactor that has both high heat radiation performance and high vibration damping performance, by placing and fixing the reactor core onto a heat radiation base formed of the metal material or the alloy material specified in one of the examples 1 to 5.

Although the embodiment of the invention has been described in detail with reference to the drawings, the configuration of the invention is not limited to the described embodiment. Design modifications and the like may be made without departing from the scope of the invention.

The invention claimed is:

1. A reactor, comprising:

a cooling block;

a heat radiation base affixed to the cooling block;

a reactor core that includes a coil, wherein the reactor core and the coil are affixed to the heat radiation base by silicon adhesive agent or epoxy adhesive agent; and a resin molded body formed on the heat radiation base to cover and seal the reactor core, coil and an exposed upper surface of the heat radiation base, wherein the heat radiation base is formed of a metal or an alloy that has a predetermined logarithmic decrement equal to or higher than 0.1, and a predetermined heat conductivity equal to or high than 10 W/mK, and wherein the reactor does not include a housing that houses the resin molded body.

2. The reactor according to claim 1, wherein the head radiation base is formed of Mg, Ni, Fe, a Mg—Zr alloy, and Al—Zn alloy, a Ni—Ti alloy, or a Mn—Cu—Ni alloy.

3. The reactor according to claim 1, wherein the resin molded body is formed of an epoxy resin or a urethane resin.

4. A reactor, comprising:

a cooling block;

a heat radiation base affixed to the cooling block;

a reactor core that includes a coil, wherein the reactor core and the coil are affixed to the heat radiation base by a silicon adhesive agent or an epoxy adhesive agent; and a resin molded body formed on the heat radiation base that covers and seals the reactor core, coil and an exposed upper surface of the heat radiation base, wherein the heat radiation base is formed of Mg, Ni, Fe, a MG-Zr alloy, an Al—Zn alloy, a Ni—Ti alloy, or a Mn—Cu—Ni alloy that has a predetermined logarithmic decrement and a predetermined heat conductivity, and wherein the reactor does not include a housing that houses the resin molded body.

* * * * *